United States Patent [19]

Becker

[11] 4,014,261

[45] Mar. 29, 1977

[54] CONVERSION DEVICE OF A STORAGE DRUM FOR SHEET TRANSFER

[75] Inventor: Willi Becker, Bammental, Germany

[73] Assignee: Heidelberger Druckmaschinen Aktiengesellschaft, Heidelberg, Germany

[22] Filed: Dec. 22, 1975

[21] Appl. No.: 642,695

[30] Foreign Application Priority Data

Dec. 20, 1974 Germany ..... 2460503

[52] U.S. Cl. ..... 101/230; 101/410; 101/183

[51] Int. Cl.[2] ..... B41F 5/02; B41F 21/04

[58] Field of Search ..... 101/229, 230, 231, 232, 101/220, 221, 222, 223, 224, 225, 410, 183, 184; 271/277, 82, 225, 69, 80

[56] References Cited

UNITED STATES PATENTS

| | | | |
|---|---|---|---|
| 2,757,610 | 8/1956 | Gegenheimer et al. | 101/183 |
| 3,385,597 | 5/1968 | Guzik | 271/82 |
| 3,443,808 | 5/1969 | Siebke | 271/82 |
| 3,455,547 | 7/1969 | Rudolph et al. | 271/82 |
| 3,796,154 | 3/1974 | Weisgerber | 101/232 |

*Primary Examiner*—J. Reed Fisher
*Attorney, Agent, or Firm*—Herbert L. Lerner

[57] ABSTRACT

An assembly of a sheet transfer drum, a sheet-turning drum and a storage drum mounted on a shaft and located therebetween for transporting a sheet between individual printing units of a rotary printing press, includes a change-over mechanism for converting the printing press from single-side sheet printing to double-side perfector printing and conversely, as well as to different format sizes, the change-over mechanism having a control shaft axially displaceable from a non-controlling position to a single control position, a first control pinion mounted on the control shaft, first adjusting means for adjusting format size for double-side perfector printing, the first control pinion being forcibly coupled to the first adjusting means, a second control pinion mounted on the control shaft, second adjusting means mounted for rotation about the shaft of the storage drum, drive gear means for converting the rotary printing press from single-side sheet printing to double-side perfector printing, first cam means for adjusting the printing press from single-side sheet printing to double-side perfector printing and conversely, second cam means for adjusting the format size for double-side perfector printing, the first control pinion, in the single control position of the control shaft, being in meshing engagement with the drive gear means, and the second control pinion, simultaneously in the single control position of the control shaft, being selectively couplable by the second adjusting means alternatively with the first cam means and with the second cam means.

17 Claims, 14 Drawing Figures

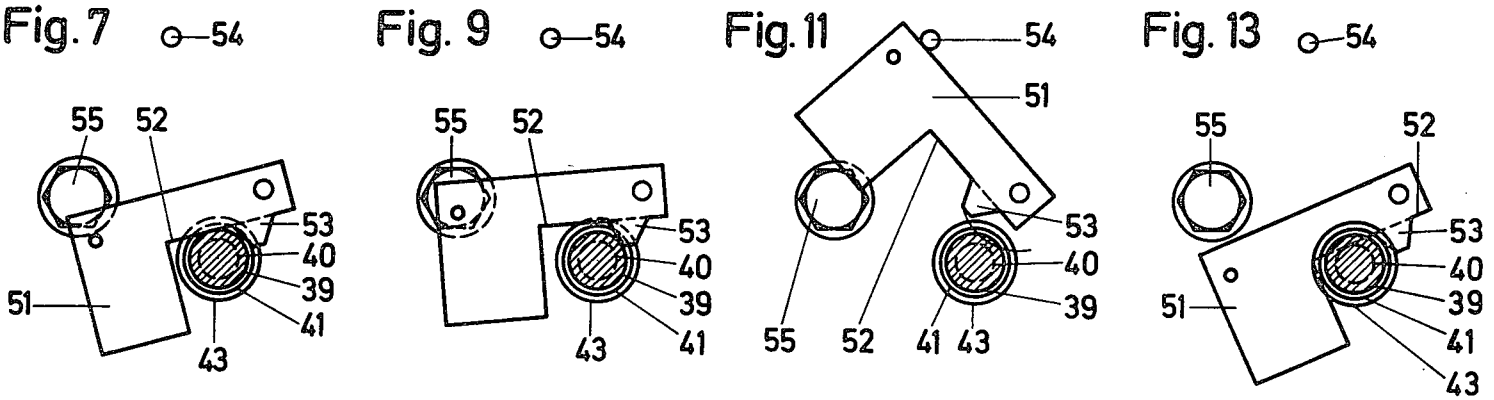
Fig. 7
Fig. 9
Fig. 11
Fig. 13
54
55
52
51
53
40
39
41
43
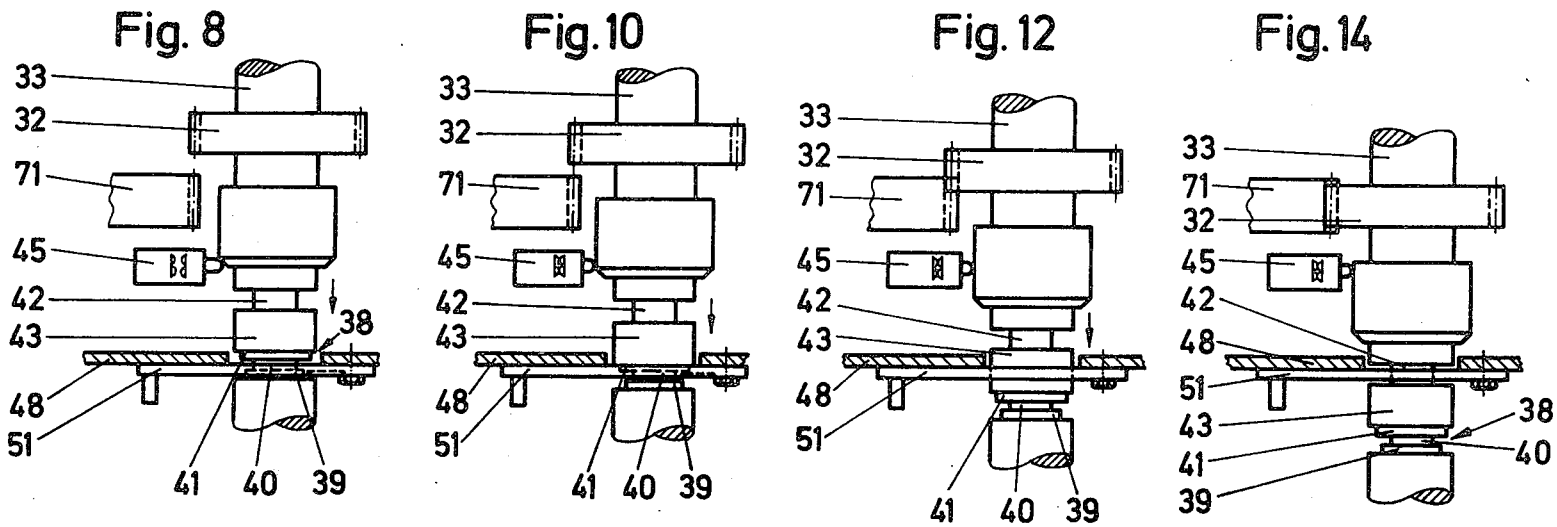
Fig. 8
Fig. 10
Fig. 12
Fig. 14
33
32
71
45
42
43
48
51
38
39
40
41

CONVERSION DEVICE OF A STORAGE DRUM FOR SHEET TRANSFER

The invention relates to a storage drum serving to transfer sheets between individual printing units of a sheet-fed rotary printing press for the purpose of converting the printing press from first form or single-side sheet printing to perfector or double-side sheet printing and also to different format sizes, the storage drum being located between a looping or transfer drum and a turning or turn-over drum and having twice the diameter thereof.

Devices of this general type are necessary in all convertible perfector printing presses. For perfecting, the sheet to be printed is transferred during the sheet travel from the first looping drum to the second looping drum (the storage drum), which is double the diameter of the first looping drum, and is guided by the second looping drum with the leading edge of the sheet past the tangential point between the looping drum of double diameter and the turning drum next succeeding the latter. As soon as the trailing edge of the sheet, which is held by the suction elements, reaches the aforementioned tangential point, it is gripped by the gripping mechanism of the turning drum. The release of the leading edge of the sheet from the front grippers occurs at the same time and the sheet is transferred with its trailing edge in leading position to the next impression cylinder. The heretofore known conversion devices of this general type have complicated mechanisms which are difficult to supervise and are therefore responsible for a lack of confidence exhibited by the printing press operators. In these heretofore known cases, the conversion or adjustment must be performed from different locations of the printing press through separate adjusting means and through separate scales associated with the individual adjusting means, whereby discrepancies arise. Depending upon the number of adjusting means, these inaccuracies are aggregative and have an unfavorable effect upon the printing quality. For example, in the case of perfector or double-side sheet printing, inaccuracies in registry are produced which necessitate corrections to the adjustment, whereby further sources of error may possibly arise.

The adjustment of the various individual functions, moreover, demands a very strong sense of responsibility on the part of the press operators and also increased time consumption to effect the conversion, whereby the productivity of the press is considerably reduced. Furthermore, the individual adjustments have an unfavorable effect upon the operational reliability and safety of the press, so that if one important individual adjustment is overlooked, there is a risk of damage to the press.

With some heretofore known conversion devices, furthermore, a large number of different tools are required for the individual adjusting operations, thereby increasing the complexity of the conversion and hence the uncertainty of the operators.

German Patent DT-PS 1 107 246 describes a sheet-fed rotary printing press having a plurality of printing units connected by transfer cylinders, wherein the transfer cylinders are equipped with a first and second sets of grippers which are selectively operable. With this prior-art construction, the individual functions must be converted consecutively by means of separate adjusting means.

Thus, for example, to convert the system of the press from first form or single side sheet printing to perfector or double-side sheet printing, relative angular adjustment of the individual printing units to one another must first be performed. Thereafter, a disc cam specific only for two-color printing must be pivoted through the intermediary of a hand lever into a rest or neutral position outside the circular path of two cam followers, and a second disc cam, which is required only for perfector or double-side sheet printing, has to be adjusted along the guide path thereof so that the cam lobe controls the time of the gripper opening through the intermediary of the cam followers. Apart from this, the groups of suction heads holding the rear edge of the sheet have to be adjusted to the trailing end of the sheet.

In view of the multiplicity of these individual adjustments, which have to be performed by separate adjusting means from different locations outside the printing press and are readable off a plurality of adjusting wheels associated with the adjusting means, discrepancies and inaccuracies will inevitably arise. Furthermore, the uncertainty of the operators is increased by the adjustment of the various individual functions, and if one important individual adjustment is overlooked, the risk of damage to the press cannot be eliminated. Furthermore, very long standstill time periods are required for the conversion, leading to reduced productivity of the press.

The cam which is only required for perfector or double-side sheet printing remains in the operative position even for first or single-side sheet printing and this causes an undesired gripper opening resulting in an unnecessarily high degree of gripper wear.

According to German Published Prosecuted Application DT-AS 2 126 258, a sheet transfer device for a sheet-fed rotary printing press having a plurality of printing units connected together by three transfer cylinders, respectively, is known which embodies an improved conversion device. In this heretofore known construction, there is disposed on the middle transfer cylinder, a gripper opening cam which causes the opening of the grippers at the surrender of the sheet to the third transfer cylinder, and is employed both for first form or single-side sheet printing and for perfecting or double-side sheet printing. Conjointly with an externally-toothed segment ring attached firmly to it, the gripper opening cam is adjustable peripherally through a gear wheel by means of an adjusting member, such as a handwheel, and is lockable by a toothed segment.

The simultaneous use of the gripper opening cam both for first form printing and also for perfecting demands a wide range of adjustment which corresponds to that of the maximum format. But it is this very long adjustment distance which is an obstacle to a combination of a plurality of adjusting functions. Furthermore, the time for conversion and hence the time the press is at standstill are considerably increased as a result.

Another disadvantage is the gradual or stepwise adjustment of the time of opening of the gripper fields of the transfer cylinder in accordance with the tooth pitch of the toothed segment ring and of the tooth segment. Because a tooth pitch $t_0 = m \cdot \pi$, in the case where $m = 2$, the tooth pitch $t_o$ corresponds approximately to 6 mm. As a result of this rough and inaccurate adjustment, the sheet travel can be impaired due to too-early or too-late release of the sheet, which inevitably leads to defects in the printing process. For example, in the case of too-late release, the sheet may be demaged or torn due to the position of the sheet turning grippers.

For the acceptance of the sheet at the leading edge of the sheet, the latter must first travel past the tip of the grippers, so that a relatively wide aperture angle of the grippers is necessary, whereas in the case of perfecting or double-side sheet printing, the gripper need only be opened slightly more than the maximum sheet thickness. Due to the simultaneous employment of the gripper opening cam for first form or single-side sheet printing and for perfector or double-side sheet printing, and due to the unnecessarily wide gripper opening which is involved in the case of perfector printing, the parts causing the opening and closing of the grippers, such as the gripper shaft, the gripper bearing and the like, are thus subject to increased wear.

Quite apart from these disadvantages, the system conversion of the press in the German Published Application, from first form to perfector printing or vice versa necessitates a plurality of adjusting operations by separate adjustment means and from different points outside the press, respectively. Moreover, the suctiion members holding the end of the sheet are not included in the process of adjustment; instead, they have to be adjusted to the sheet end by separate adjusting elements.

German Patent DT-PS 1 611 241 concerns a sheet transfer cylinder for printing presses, wherein the leading front edge of the sheet is gripped by grippers and the trailing rear end of the sheet by devices which are movable in the direction of rotation of the cylinder. The devices gripping the rear edge of the sheet are constructed in the last-mentioned German Patent, as suction and blowing heads and are mounted on shaft support wheels which are adjustable through the intermediary of an annular supporting part. By rotating this supporting part relatively to the shaft of the transfer cylinder, the suction and blowing heads are movable towards and away from the grippers and are thus adjustable to the trailing edge of sheets of paper of varying length.

The range of adjustment of this heretofore known device is limited, however, because the adjustment can be performed only within the limits of circular arcuate slots which are formed in sheet support wheels fastened on the shaft of the transfer cylinder and wherein the vacuum arm shafts to which the suction and blowing heads are secured, move in peripheral direction.

Furthermore, in the last-mentioned German Patent, the relative rotation of the printing units must be performed in a separate adjustment operation by separate adjusting means. Consequently, the possibilities of error, the dangers of overlooking the adjustment of one individual function of the press, and the uncertainty on the part of the operators, referred to hereinbefore, are not eliminated by this separate adjusting means.

In the case of a device for gripping a sheet of paper on a transfer cylinder of a printing press of multicolor printing, as well as for perfector printing, likewise known from German Published Non-Prosecuted Application DT-OS 2 228 671, the conversion of system and/or format of the press is effected by rotating a pinion by means of which an adjustable annular segment on which the gripper cam is fastened can be converted. The cam attached to the annular segment cooperates with two followers which, in turn, control the grippers through levers. The magnitude of the rotation being readable visually off a scale with a needle indicator.

In this adjusting operation of the German Published Non-Prosecuted Application, the suction bars are automatically included in the conversion, so that the distance between the suction members and the grippers of the following looping or transfer drum does not change. However, this operation also represents only the conversion of one individual function of the machine. For example, for perfector printing, the adjustment to the format to be processed has to be performed in a separate operation. Due to this, the difficulties already referred to hereinbefore are not eliminated. Apart from the increased time consumption for the separate adjusting functions, the inaccuracies which inevitably arise in the individual adjustments accumulate and have a negative effect upon the quality of the printing, rendering further adjustment corrections necessary.

Also disclosed in German Patent DT-PS 2 227 151, is a conversion device for an apparatus for tensioning sheets of paper, more particularly in a sheet turning device of multicolor printing presses. In order to adjust the format, the two printing units are converted by driving gearwheels, so that the grippers of the transfer cylinder are moved into an appropriate surrender position to the next transfer cylinder. By rotating an additional gearwheel which is connected to the support tube of the suction members, the suction members participate in the adjustment and a constant position with respect to the grippers of the next looping drum is thereby maintained at all times.

This last-mentioned heretofore known construction therefore likewise embraces only one part of the conversion, whereas the adjustment of the remaining functions (adjustment of the gripper opening cams both for first form and for perfector printing) must be effected by separate means, and the inaccuracies and dangers due to the individual adjustments which have been referred to hereinbefore still remain. Furthermore, in printing presses of modern construction which are equipped with a cylinder drive which is encapsulated, subjected to oil trickling or running in an oil bath, it is impossible to employ such a construction because the driving gearwheels are located outside the supporting side walls.

It is accordingly an object of the invention to provide a problem-free conversion device for a storage drum which positively assures the precision dictated by manufacture and pre-adjusted during assembly, both for first form and for perfector printing, and which permits the processing of all required format sizes.

It is a further object of the invention to provide such a conversion device wherein all the operations independent of forcibly necessary tensionings and lockings of the adjusting members and of screw-securing means for the conversion of the printing press dictated by the function thereof are reduced to a minimum.

It is another object of the invention to provide such a conversion device which offers a basis for a simple and uncomplicated conversion of the press, while the necessary operations both for the system conversion and also for the format adjustment and for the system resetting are synchronous in number and sequence.

It is an additional object of the invention to provide such a conversion device wherein the entire adjustment of functions are adjustable by means of a single control element from one point located outside the press with the shortest possible adjustment path and is readable on a common scale for better supervision.

It is an added object of the invention to provide such a conversion device wherein the possibility of the occurrence of operating errors and the resulting danger of damage to the press is reduced to a minimum by the incorporation of safety devices.

With the foregoing and other objects in view, there is provided in accordance with the invention, in an assembly of a sheet-transfer drum, a sheet-turning drum and a storage drum mounted on a shaft and located therebetween for transporting a sheet between individual printing units of a rotary printing press, a change-over mechanism for converting the printing press from single-side sheet printing to double-side perfector printing and conversely, as well as to different format sizes, the change-over mechanism comprising a control shaft axially displaceable from a noncontrolling position to a single control position, a first control pinion mounted on the control shaft, first adjusting means for adjusting format size for double-side perfector printing, the first control pinion being forcibly coupled to the first adjusting means, a second control pinion mounted on the control shaft, second adjusting means mounted for rotation, about the shaft of the storage drum, drive gear means for converting the rotary printing press from single-side sheet printing to double-side perfector printing, first cam means for adjusting the printing press from single-side sheet printing to double-side perfector printing and, conversely, second cam means for adjusting the format size for double-side perfector printing, the first control pinion, in the single control position of the control shaft being in meshing engagement with the drive gear means and the second control pinion, simultaneously in the single control position of the control shaft, being selectively couplable by the second adjusting means alternatively with the first cam means and with the second cam means.

In accordance with another feature of the invention, the assembly includes safety means for protecting the combined adjustment of the change-over mechanism from single-side sheet printing to double-side perfector printing and conversely and to different format sizes for double-side perfector printing.

In accordance with a further feature of the invention, the storage drum comprises rearward sheet-supporting segments rotatably mounted on the shaft of the storage drum, sheet guidance and holding means disposed on the rearward sheet-supporting segments for gripping the trailing edge of a sheet being transferred by the assembly, suction air control means cooperatively connected with the sheet guidance and holding means, forward sheet-supporting segments fixedly mounted on the shaft of the storage drum, the first control pinion being operatively connected to the rear sheet-supporting segments for adjustably rotating the rear sheet-supporting segments, the sheet-guidance and holding means and the suction air control means relative to the fixed forward sheet-supporting segments.

In accordance with an added feature of the invention, the printing press has a pair of spaced-apart side walls, and including another control shaft axially displaceably mounted in the side walls and extending parallel to the shaft of the storage drum and beyond the periphery of the storage drum, across the entire width thereof, the first adjusting means comprising one part mounted on the other control shaft for adjusting the sheet supporting segments and the sheet guidance and holding means and for adjusting suction air control time of suction air control means, and another part operatively associating the other control shaft with the first-mentioned control shaft, and a pair of entraining discs mounted on the other part and axially displaceably coupling the other control shaft to the first mentioned control shaft.

In accordance with an additional feature of the invention, wherein gripper members are carried by the storage drum, the assembly includes bearing bushing means carried by one of the side walls and formed with a lug, the second adjusting means being rotatably mounted on the bearing bushing in loose operating connection with the second cam means for actuating the gripper members for double-side perfector printing, and bracket means secured to the lug and carrying the second adjusting means.

In accordance with yet another feature of the invention, the second adjusting means comprises a toothed disc which, in the single operative position of the first-mentioned control shaft, is in meshing engagement with the second pinion, the second cam means being formed as a gripper opening cam for double-side perfector printing and being slidably mounted in guide means of a gripper closing cam forming the bracket means and an entrainer bolt secured on a toothed disc and loosely extending into a corresponding entrainer bore formed in the gripper opening cam for displacing the gripper opening cam.

In accordance with yet a further feature of the invention, the assembly includes a bolt secured in the one side wall above the bearing bushing means and extending through a slot formed in the toothed disc, the first cam means being pivotably mounted on the last-mentioned bolt for actuating the gripper members of the storage drum for single-side sheet printing.

In accordance with another feature of the invention wherein the first cam means comprise a gripper opening cam for single-side sheet printing, the assembly includes a tension spring fastened to an end of the gripper opening cam, on the one hand, and to the bearing bushing means, on the other hand, for biasing the gripper opening cam toward the bearing bushing means, and a cam member fixed to the toothed disc and operatively engageable with the gripper opening cam.

In accordance with a further feature of the invention, the control shaft is formed with a groove corresponding to a non-controlling position of the control shaft and a recess corresponding to the single control position of the control shaft for locking and securing the control shaft in the non-controlling and control position, respectively, and including a guard wall located in front of the drive gear means and secured to the exterior of a side wall of the printing press, the guard wall being formed with a bore and with an opening and having a latch pivotally mounted thereon, the control shaft extending through the bore, and the latch being selectively in engagement in the groove and in the recess depending upon the axial position of the control shaft.

In accordance with an added feature of the invention, the groove is formed with three sections of reduced diameter, the reduced diameter of one of the sections being equal to the reduced diameter section in the recess.

In accordance with an additional feature of the invention, the latch is formed with two arms extending at an angle to one another and formed with a lug, one of the latch arms having an inner edge which, together with said lug, are operatively engageable with the reduced-diameter sections.

In accordance with yet another feature of the invention, a stop bolt is secured to the exterior of the guard wall above the pivot range of the pivotable latch.

In accordance with yet a further feature of the invention, a limit switch is secured to the exterior of the side wall and the assembly includes a control hub located on the control shaft, the limit switch being operatively associated with the control hub in the single operative position of the control shaft.

In accordance with another feature of the invention, the assembly includes a tensioning screw located on the one side wall above the control shaft for locking the toothed disc, a tensioning nut mounted on the tensioning screw outside the one side wall, a plate fastened to the tensioning nut and operatively associated with a control hub fixed on the first-mentioned control shaft for securing axial displacement of the first-mentioned control shaft.

In accordance with a further feature of the invention, the assembly includes tensioning straps fastened by tensioning screws to the outer segments of the forward sheet-supporting segments including a disc threadedly secured to the outer segment of the rearward sheet-supporting segments that is located adjacent the one side wall, and a ring gear threadedly secured to the outer segment of the rearward sheet-supporting segments that is located adjacent the other of the side walls, the disc and the ring gear being clampable by the tensioning straps and the tensioning screws.

In accordance with an added feature of the invention, the suction air control means comprises a valve fixed to the interior of the other of the side walls, and the assembly includes a control disc fastened to the outer segment of the rearward sheet-supporting segments located adjacent the other of the side walls, the control disc being connected by a connecting tube to the sheet gripping means on the rotatable rearward sheet-supporting segments, the sheet gripping means being a suction bar.

In accordance with an additional feature of the invention, the drive gear means drives the turning drum and is formed with a lug, and the assembly includes tensioning screws and tensioning claws clamping a rotatable ring gear on the lug, the ring gear being in meshing engagement with drive gear means for driving the storage drum, and a scale is located on the ring gear, and an indication needle cooperates with the scale and is carried by the drive gear means for driving the turning drum.

Other features which are considered as characteristic for the invention are set forth in the appended claims.

Although the invention is illustrated and described herein as embodied in conversion device of a storage drum for sheet transfer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 5:
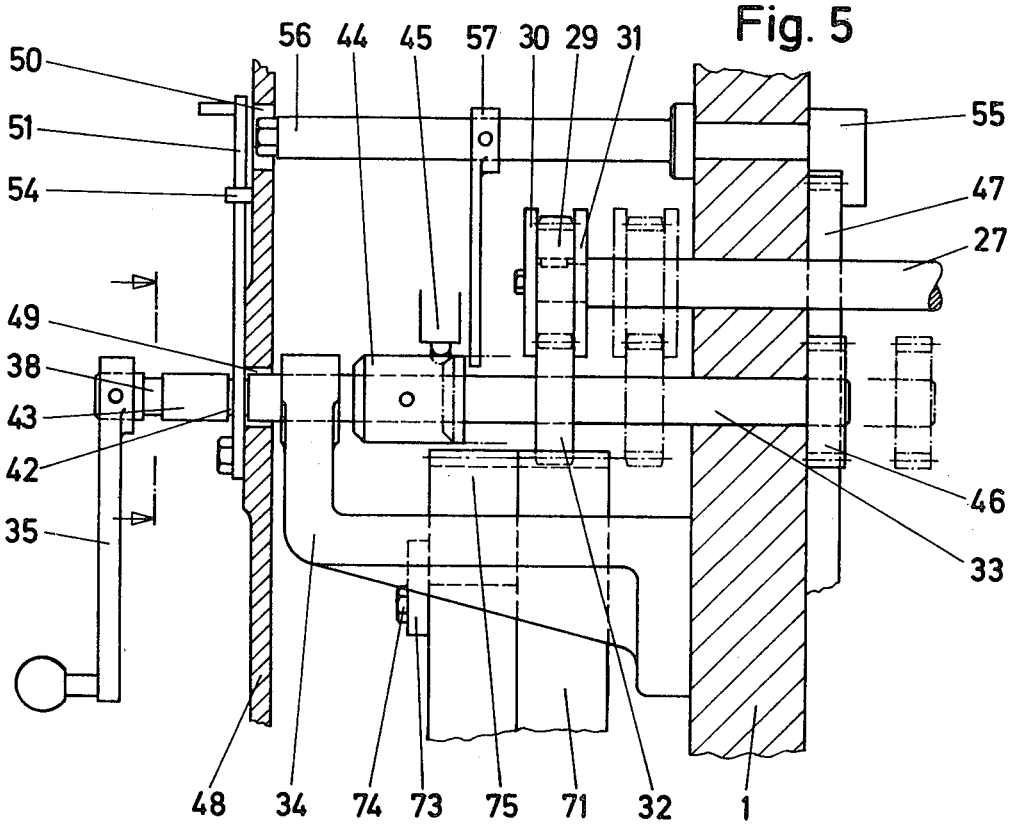
FIG. 5 is an enlarged fragmentary view of FIG. 1 showing the adjusting device of the invention.
Figure 6:
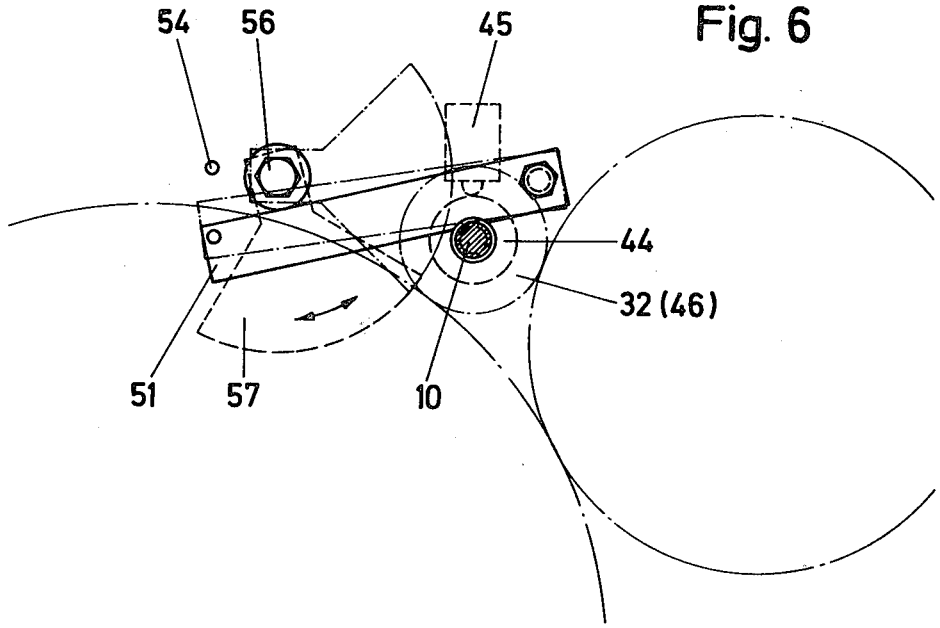
FIG. 6 is a fragmentary diagrammatic elevational view of FIG. 5 in direction of the arrows shown at the left-hand side of FIG. 5.

FIGS. 7—14 are sequentially views similar to FIG. 6 and FIG. 5 for each of four different positions of the latch cooperating with the adjusting shaft.

Referring now to the drawing and first, particularly, to FIGS. 1 to 4 thereof, there are shown mounted in side walls 1 and 2 of a printing press, successively disposed in direction of travel of a sheet 24 (FIG. 4), a transfer or looping drum 3 with clamping grippers 4, a storage drum 5 and a turn-over or turning drum 6 with tongs-like grippers 7. The storage drum 5, in travel direction of a sheet, is formed of forward segments 8 which are firmly secured to a shaft 9 of the storage drum 5, and rearward segments 10 which are mounted so as to be rotatable on the shaft 9.

Figure 1:
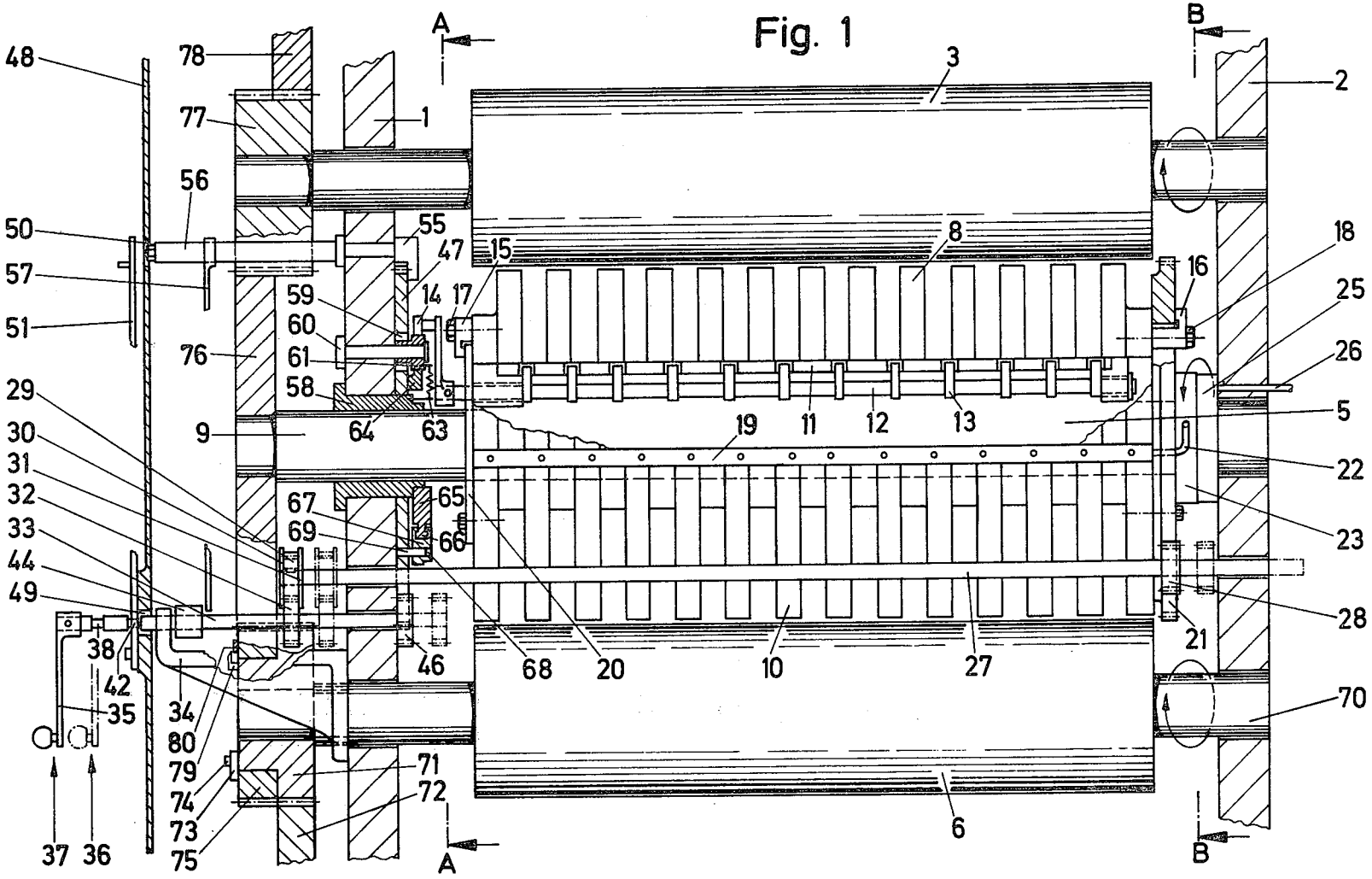
FIG. 1 is a fragmentary top plan view, partly in cross-section, of a printing press showing an assembly of a transfer or looping drum, a storage drum and a sheet turn-over or turning drum with a drive and an adjustment device in accordance with the invention.

A gripper bridge 11 with a gripper shaft 12 and a multiplicity of grippers 13 is threadedly fastened to the fixed row of forward segments 8. Cam followers 14 fastened to the gripper shaft 12 by means of cam levers, as shown in FIG. 1, are provided for controlling the grippers 13. At both of the outermost forward segments 8, tensioning straps 15 and 16 are applied, the straps 15 and 16 being adjustable by means of tensioning screws 17 and 18 to the outer sides of both of the outer forward segments 8, respectively. A suction bar 19 is threadedly secured to the rotatable row of rearward segments 10, a disc 20 similarly secured to the outer rearward segment 10 located adjacent or facing the side wall 1, and a toothed ring 21 similarly secured to the outside of the rearward segment 10 located adjacent or facing the side wall 2, as shown in FIG. 1.

The suction bar 19 is connected by a connecting tube 22 to a control disc 23 which is firmly screwed to the outer rearward segment 10 located adjacent the side wall 2 and which controls the suction air for holding the trailing edge of the sheet 24. A suction air control valve 25, which is connected by a supply tube 26 to a non-illustrated suction air supply unit, is fastened to the inner surface of the side wall 2.

As is clearly seen in each of FIGS. 1 to 5, a shaft 27 is mounted so as to be axially displaceable above the storage drum 5 and beyond the periphery thereof. Between the outermost of the rearward segments 10 and the side wall 2 there is fastened on the shaft 27 a first adjusting pinion 28 which can be brought into engagement with the toothed ring 21 by axial displacement of the shaft 27. A second adjusting pinion 29 is fastened on the end of the shaft 27 located outside the side wall 1. This adjusting pinion 29 is non-releasably coupled to an adjusting pinion 32 of an adjusting shaft 33 by entraining discs 30 and 31, disposed on both sides of the pinion 29.

The adjusting shaft 33 is axially displaceably mounted in the side wall 1 and on a bearing block 34 fixed to the side wall 1. The adjusting shaft 33 is provided at the outer end thereof with a crank 35 by means of which it can be axially displaced from a neutral or rest position 36 (shown in phantom in FIG. 1) into an operative position 37 (shown in solid lines in FIG. 1) as well as be rotated. Forward of the crank 35, as shown more clearly in FIGS. 7 to 14, a groove at reduced-diameter section 38, which is associated or coordinated with the rest or neutral position 36 of the adjusting shaft 33, is formed in the latter and has three different diameters 39, 40 and 41. The adjusting shaft 33, as shown in FIGS. 8, 10, 12 and 14, is also provided with another recess or reduced-diameter section 42 which is provided for locking the adjusting shaft 33 in the operative position 37 of the adjusting shaft 33. The diameter of the section 40 in the groove 38 has a diameter equal to that of the recess or reduced-diameter section 42. The adjusting shaft 33 is formed with a large-diameter section 43 between the groove 38 and the recess 42.

Between the eye of the bearing block and the side wall 1, a control hub 44 keyed to the adjusting shaft 33 and, in the operative position 37 of the adjusting shaft 33, cooperates with a limit switch 45 which is secured in a non-illustrated conventional manner to the exterior of the side wall 1. Between the control hub 44 and the side wall 1, the adjusting pinion 32, which meshes non-releasably with the adjusting pinion 29, as mentioned hereinabove, is fastened on the adjusting shaft 33. On the inner end of the adjusting shaft 33, an adjusting pinion 46 is fixedly mounted and can be brought into meshing engagement with a toothed disc 47 in the operative position 37 of the adjusting shaft 33.

Forward of respective driving gear-wheels 71, 72, 76, 77 and 78 a guard 48 is fastened to the exterior of the side wall 1 and is provided with a bore 49 and an opening 50. The adjusting shaft 33 extends through the bore 49, while the opening 50 is provided to permit the insertion therein of a tool, such as a socket wrench or box spanner, for example. Also attached to the guard 48 is a latch 51 which is formed with two arms disposed at right angles to one another, as shown in FIGS. 7, 9, 11 and 13. The inner surface 52 of one of the two arms is provided with a lug 53, the surface 52 and the lug 53, depending upon the axial positioning of the adjusting shaft 33, engaging in one of the three reduced-diameter sections 39, 40 or 41 of the groove 38 formed in the adjusting shaft 33, or in the reduced-diameter section or recess 52 also formed in the adjusting shaft 33. Upwardly directed pivoting travel of the latch 51, as viewed in FIGS. 5, 7, 9, 11 and 13, is limited by a stop pin 54 which is fastened to the guard 48 above the latch 51.

In the side wall 1 at the level of the periphery of the storage drum 5, there is disposed a tensioning screw 55 with which the toothed disc 47 can be firmly clamped to the interior of the side wall 1, by means of a tensioning nut 56 mounted outside the side wall, on the tensioning screw 55. Approximately in the middle of the tensioning nut 56, a plate 57 is fastened which, in the open condition of the tensioning nut 56, assumes a position behind the control hub 44, in the operative position 37 of the adjusting shaft 33, and blocks the control hub 44 against axial displacement. In correctly tightened condition of the tensioning nut 56, the plate 57 is pivoted so that it clears the path for the axial displacement of the adjusting shaft 33.

The toothed disc 47 lockable by the tensioning screw 55 is rotatably mounted on a bearing bushing 58 fixed to the side wall 1. The toothed disc 47 is formed along part of the periphery thereof with a circular arcuate slot 59 through which a bolt 60 fastened to and passing through the side wall 1, extends. On this bolt 60, a gripper opening cam 61 for first form, or single-side sheet printing is pivotally mounted, the cam 61 being provided on the underside thereof, as viewed in FIG. 1, with a cam gradient 62, and having a free end which is biased through a tension spring 63 toward a shoulder of the bearing bushing 58. A cam member 64 which cooperates with the cam gradient 62, is also threadedly secured to the toothed disc 47 beneath the slot 59.

On the shoulder of the bearing bushing 58, there is fastened a gripper closing cam 65 which is of circular arcuate construction in a partial region thereof and is provided with guide means 66, which has, for example, a T-shaped dovetail or similar cross section. A gripper opening cam 67 for double-side sheet printing or perfector printing is mounted slidingly in this guide means 66. An entrainer bore 68, wherein an entrainer bolt 69, that is fastened to the toothed disc 47, is loosely engaged, is formed in the gripper opening cam 67.

On a shoulder of the shaft 70 of the sheet turn-over or turning drum 6 there is mounted the drive gear 71 which meshes with the drive gear 72 of the non-illustrated impression cylinder of the second printing unit, as well as, in the operative position 37 of the adjusting shaft 33, with the adjusting pinion 32. On a neck of the drive gear 71, a gear rim or ring gear 75 is firmly clamped by means of tensioning claws 73 and tensioning screws 74, the ring gear 75 being operatively associated with the drive gear 76 of the storage drum 5, with the twice-as-wide drive gear 77 of the looping or transfer drum 3, and with the drive gear 78 of the impression cylinder of the non-illustrated first printing unit. A needle 79 is fastened to the drive gear 71, and a scale 80 carried by the ring gear or gear rim 75 and having a zero marking 81 is associated or coordinated with the needle 79.

The principle of operation of the hereinaforedescribed device of the invention of the instant application is explained more fully hereinafter.

The drive is effected through the drive gear 78 of the non-illustrated impression cylinder of the first printing unit, and is transmitted progressively by the twice-as-wide drive gear 77, the drive gear 76 and by the ring gear or gear rim 75 and the drive gear 71 to the drive gear 72 of the non-illustrated impression cylinder of the second printing unit.

Figure 2:
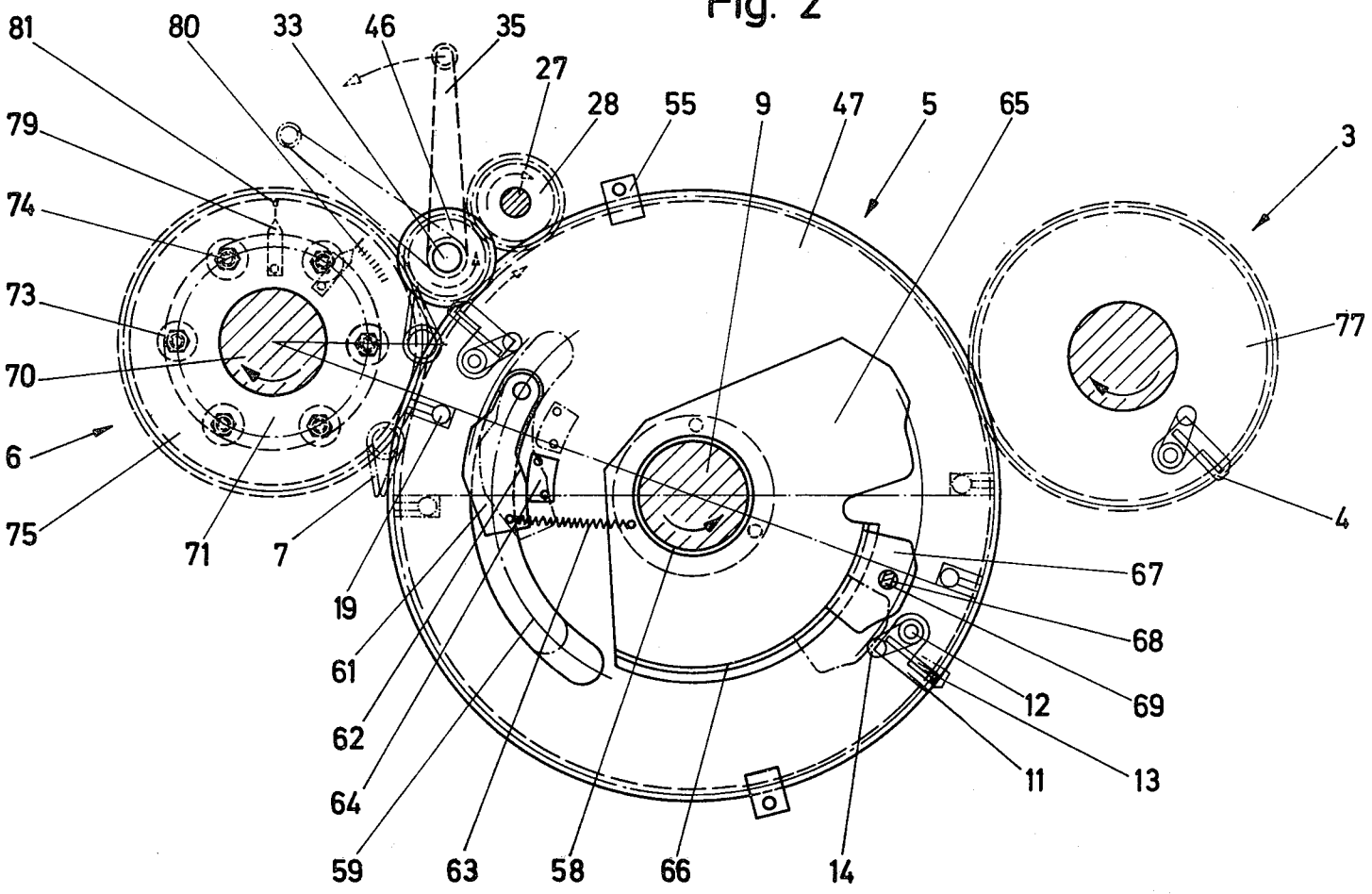
FIG. 2 is a longitudinal sectional view of FIG. 1, taken along the line A—A in the direction of the arrows and rotated clockwise through 90°, showing, in solid lines, the looping drum, storage drum and turning drum in first form position i.e. single-side sheet printing, for maximum format, and, in phantom, in the perfecting position i.e. double-side sheet printing, for maximum format.
Figure 3:
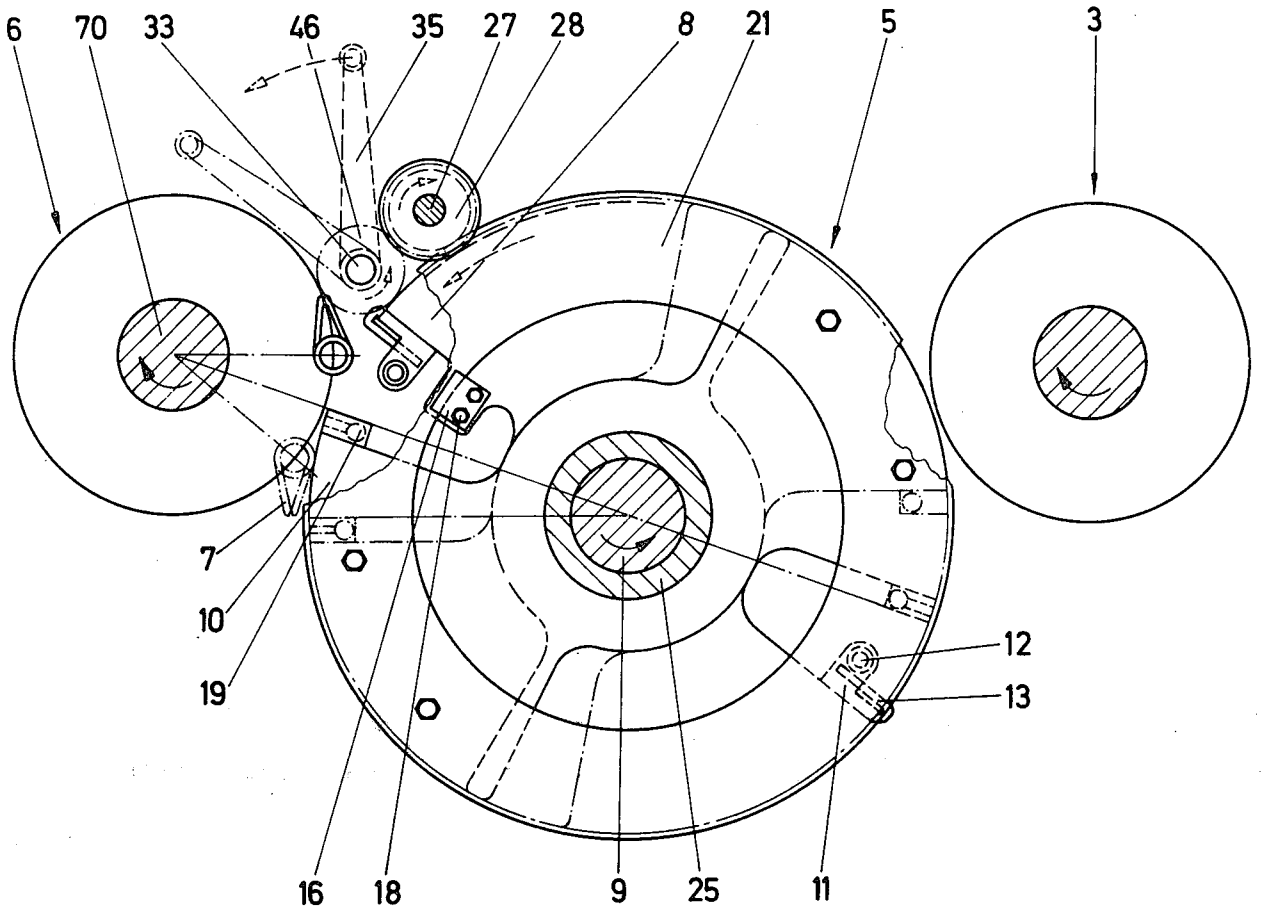
FIG. 3 is a longitudinal sectional view of FIG. 1, taken along the line B—B in the direction of the arrows and rotated clockwise through 90°, showing the assembly of the invention in the same modes of operation as in FIG. 2.
Figure 4:
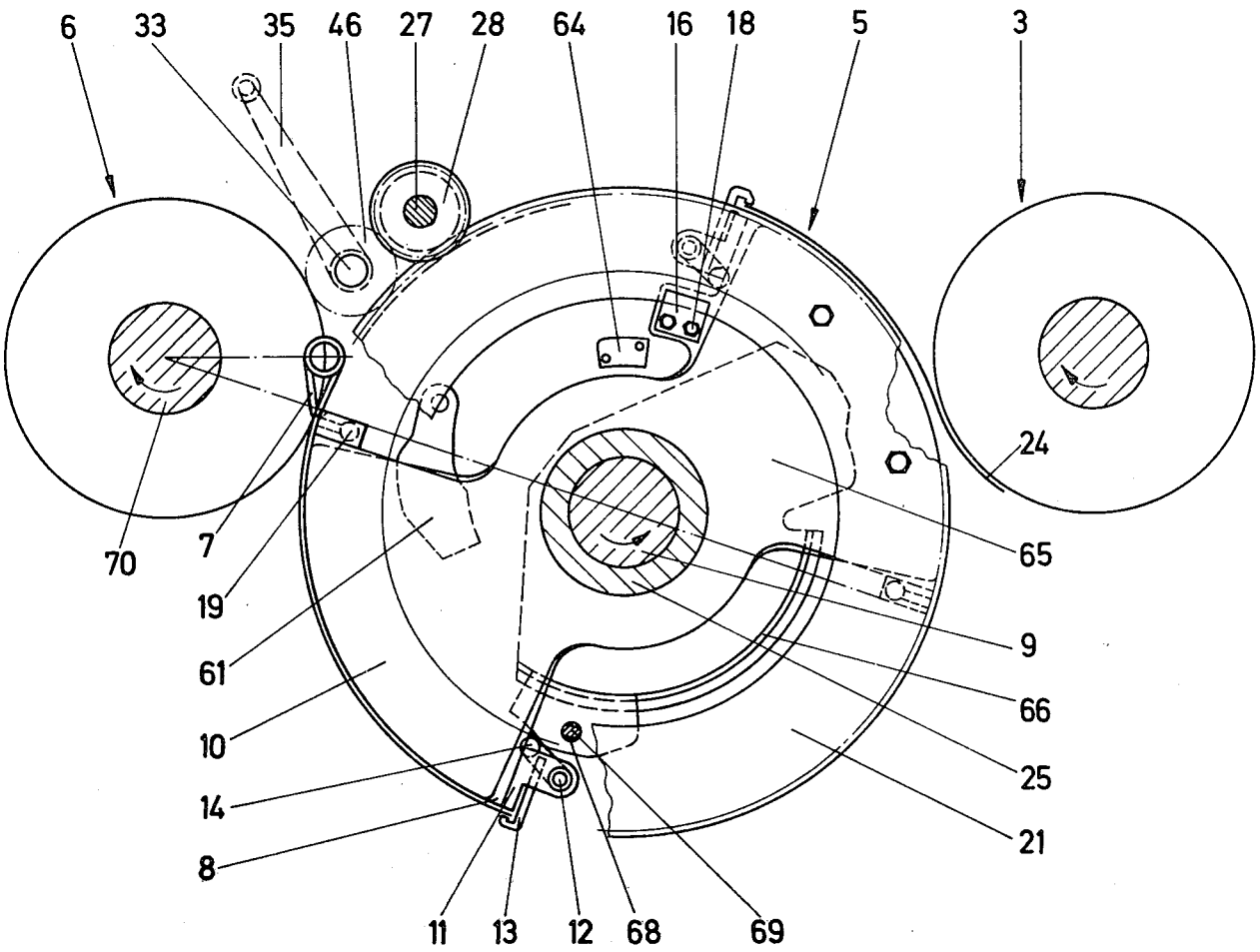
FIG. 4 is a longitudinal sectional view of FIG. 1 similar to that shown in FIG. 3 with the exception that the mode of operation depicted therein is the perfecting position i.e. double-side sheet printing, during sheet transfer.

For conversion, the press must first be brought, by mechanically inching forward, into a position wherein the zero marking 81 of the scale 80 is substantially vertical, as shown in FIG. 2.

The latch 51, which engages in the groove 38 in the rest or neutral position 36 of the adjusting shaft 33, covers the opening 50 formed in the guard 48 sufficiently so as to prevent any tool from being inserted therein. In a first step, the latch 51 must be lifted far enough out of the reduced-diameter section 40 of the groove 38, which marks the rest or neutral position 36, so that the lug 53 of the latch 51 strikes the reduced-diameter section 39 of the groove 38. In the latter position, the inner surface 52 of the latch 51 is located at the level at which the adjusting shaft 33 can be slid axially outwards with the reduced-diameter section 43 of the adjusting shaft 33 following the groove 38 strikes against the arm of the latch 51 (FIGS. 9 and 10).

During this axial adjustment of the adjusting shaft 33, the limit switch 45 is depressed by the control hub 44, which blocks the operation of the printing press. The depression of the limit switch 45 occurs at a time when the adjusting pinion 32 has not yet meshed with the drive gear 71. In order to establish operative position 37, the adjusting shaft 33 must be slid axially outwardly farther yet in a second step. For this purpose the latch 51 is lifted out from the reduced-diameter section 41 of the groove 38 and is pivoted towards the stop pin 54 until the lug 53 of the latch 51 has emerged from the reduced-diameter section 43 (FIG. 11). The adjusting shaft 33 is then slid axially into the operative position 37 thereof, and the latch 51 is engaged in the recess 42.

In this operative position 37 of the adjusting shaft 33, which is fixed by the recess 42, the opening 50 in the guard 48, which was previously covered by the latch 51, is now exposed, and a tool can then be inserted therethrough to loosing the tensioning or clamping nut 56. The safety device afforded by the different reduced-diameter section 39 and 43 of the adjusting shaft 33 therefore makes it possible for the clamping of the toothed gear 47 to be released only in the operative position 37 of the adjusting shaft 33 and, in the event of careless handling of the crank 35 during the operation of the printing press, the crank 35 can be moved from the rest position 36 into the operative position 37 of the adjusting shaft 33 only after a considerable delay, so that by that time switching-off of the press through the limit switch 45 would have already been fully effective.

In this operative position 37, the adjusting pinion 32 is in meshing engagement with the drive gear 71, and the adjusting pinion 46 with the toothed disc 47. Furthermore, due to the forcibly concurrent sliding of the shaft 27 during the adjustment through the non-releasable connection thereof to the adjusting shaft 33, the adjusting pinion 28 is coupled with the ring gear 21.

By loosening the tensioning or clamping nut 56 through the opening 50 in the guard 48, which is now exposed, the tensioning or clamping of the toothed disc 47 to the inner surface of the side wall 1 by the tensioning screw 55 is released. Simultaneously, the plate 57 fastened to the tensioning nut 56 is pivoted into a position in which it is located behind the control hub 44 and secures the adjusting shaft 33 against inward axial displacement. Decoupling of the adjusting pinion 32 from the drive gear 71 can therefore likewise only occur when the tensioning or clamping nut 56 is retightened with a specific torque, so that the plate 57 is pivoted out of the vicinity of the control hub 44 and again releases the adjusting shaft 33 so that it can be axially displaced.

These security or safety measures by means of the plate 57 and of the blocked opening 50 of the guard 48 similarly prevent accidental premature release of the clamping of the toothed disc 47 and premature decoupling of the adjusting pinions 28, 32 and 46 from their toothed counterparts 21, 47 and 71. The possibility of an insufficient tightening of the tensioning or clamping nut 56, which would result in an adjustment of the toothed wheel 47 with the gripper opening cam 67 for perfecting or double-side sheet printing during the operation of the printing press, is also completely eliminated by this means.

The tensioning straps 15 and 16 must then be released by means of the tensioning screws 17 and 18, the firm connection of the row of rotatable segments 10, to which the suction bar 19 is fastened, to the row of stationary segments 8, on which the gripper unit 11, 12 and 13 is fastened, is broken. Thereafter, the tensioning or clamping of the ring gear or gear rim 75 to the drive gear 71 is released by loosening the tensioning screw 74 of the tensioning claw 73, so that the ring gear or gear rim 75 becomes freely rotatable. The printing press is then ready for the actual adjustment.

For the system adjustment of the printing press from first form or single-side sheet printing to perfecting or doube-side sheet printing for a maximum format size, the following individual functional adjustments are now simultaneously effected by rotating the crank 35.

The sheet turning drum 6 and the non-illustrated succeeding second printing unit are rotated through a specific phase angle relative to the storage drum 5 and to the non-illustrated first printing unit preceding the same. The row of rotatable segments 10 with the suction bar 19 fastened thereto is concurrently rotated by the adjusting pinion 28 through the ring gear or gear rim 21 so that the position of the suction bar 19 with respect to the tongs-like gripper 7 of the succeeding turning drum 6 remains constant. Through the rotation of the toothed disc 47 by means of the adjusting pinion 46, the gripper opening cam 67 for perfector or double-side sheet printing is slid in the guide means 66 of the gripper closing cam 65 through the entraining pin 69 into a position wherein it effects the gripper opening in conformity with the desired format length. Simultaneously, the cam member 64 fastened to the toothed disc 47 travels past beneath the cam gradient 62 of the gripper opening cam 61, the gripper opening cam 61 for first form or single-side sheet printing pivoting inwardly due to the biasing effect of the tension spring 63 into an inoperative position in which it is ineffective. Due to the fastening of the control disc 23 of the suction air control valve 25 to the rear row of rotatable segments 10, the suction air control time for the suction bar 19 to hold the trailing edge of the sheet 24 is automatically co-adjusted.

The adjustment to smaller format sizes in the perfecting or double-side sheet printing position of the printing press is effected by means of further rotation of the crank 35 in the same direction of rotation, during which the position of the suction bar 19 relative to the tongs-like grippers 7 of the turning drum 6 is not changed, but the distance between the suction bar 19 and the grippers 13 of the storage drum 5 is changed in conformity with the desired format length, and the gripper opening cam 67 for perfecting or double-side sheet printing is moved automatically into the correct position for the appropriate format.

After the conversion has been completed, the disc 20 and the ring gear or gear rim 21 must be firmly clamped once more to the front row of stationary segments 8 by means of the tensioning straps 15 and 16 and by tightening the tensioning screws 17 and 18. Thereafter, the ring gear or gear rim 75 must again be firmly clamped on the drive gear 71 by means of the tensioning claws 73 and tensioning bolts 74. Finally, the toothed disc 47 must be locked to the inner surface of the side wall 1 by means of the tensioning screw 55. This is effected by tightening the tensioning or clamping nut 56, the plate 57 fastened to the latter being simultaneously pivoted out of the vicinity of the control hub 44 and thereby the axial adjustment of the adjusting shaft 33 is again released. Only after this last adjusting element, namely the toothed wheel 47, has been secured, can the adjusting shaft 33 be slid inwardly into the rest or neutral position 36 thereof after the latch 51 has been lifted out of the recess or reduced-diameter section 42. The limit switch 45 is then released by the control hub 44 and the blockage of the operation of the printing press is thereby broken.

The printing press is then ready to be operated in the perfector or double-side sheet printing mode in the desired format.

The operations for reverse system adjustment of the printing press from perfect or double-side sheet printing to first form or single-side sheet printing are performed in the same sequence, only the direction of rotation of the crank 35 being opposite.

I claim:

1. In an assembly of a sheet-transfer drum, a sheet-turning drum and a storage drum mounted on a shaft and located therebetween for transporting a sheet between individual printing units of a rotary printing press, a change-over mechanism for converting the printing press from single-side sheet printing to double-side perfector printing and conversely as well as to different format sizes, the change-over mechanism comprising a control shaft axially displaceable from a non-controlling position to a single control position, a first control pinion mounted on said control shaft, first adjusting means for adjusting format size for double-side perfector printing, said first control pinion being forcibly coupled to said first adjusting means, a second control pinion mounted on said control shaft, second adjusting means mounted for rotation about the shaft of the storage drum, drive gear means for converting the rotary printing press from single-side sheet printing to double-side perfector printing, first cam means for adjusting the printing press from single-side sheet printing to double-side perfector printing and conversely, second cam means for adjusting the format size for double-side perfector printing, said first control pinion in said single control position of said control shaft, being in meshing engagement with said drive gear means, and said second control pinion, simultaneously in said single control position of said control shaft, being selectively couplable by said second adjusting means alternatively with said first cam means and with said second cam means.

2. Assembly according to claim 1 including safety means for protecting the combined adjustment of the change-over mechanism from single-side sheet printing to double-side perfector printing and conversely and to different format sizes for double-side perfector printing.

3. Assembly according to claim 1 wherein the storage drum comprises rearward sheet-supporting segments rotatably mounted on the shaft of the storage drum, sheet guidance and holding means disposed on said rearward sheet-supporting segments for gripping the trailing edge of a sheet being transferred by the assembly, suction air control means cooperatively connected with said sheet guidance and holding means, forward sheet-supporting segments fixedly mounted on the shaft of the storage drum, said first control pinion being operatively connected to said rear sheet-supporting segments for adjustably rotating said rear sheet-supporting segments, said sheet-guidance and holding means and said suction air control means relative to said fixed forward sheet-supporting segments.

4. Assembly according to claim 3 wherein the printing press has a pair of spaced-apart side walls, and including another control shaft axially displaceably mounted in the side walls and extending parallel to the shaft of the storage drum and beyond the periphery of the storage drum across the entire width thereof, said first adjusting means comprising one part mounted on said other control shaft for adjusting said sheet supporting segments and said sheet guidance and holding means and for adjusting suction air control time of said suction air control means, and another part operatively associating said other control shaft with the first-mentioned control shaft, and a pair of entraining discs mounted on said other part and axially displacably coupling said other control shaft to the first-mentioned control shaft.

5. Assembly according to claim 4 wherein gripper members are carried by the storage drum, and including bearing bushing means carried by one of the side walls and formed with a lug, said second adjusting means being rotatably mounted on said bearing bushing in loose operating connection with said second cam means for actuating the gripper members for double-side perfector printing, and bracket means secured to said lug and carrying said second adjusting means.

6. Assembly according to claim 5 wherein said second adjusting means comprises a toothed disc which, in said single operative position of said first-mentioned control shaft, is in meshing engagement with said second pinion, said second cam means being formed as a gripper opening cam for double-side perfector printing and being slidably mounted in guide means of a gripper closing cam forming said bracket means and an entrainer bolt secured in said toothed disc and loosely extending into a corresponding entrainer bore formed in said gripper opening cam for displacing said gripper opening cam.

7. Assembly according to claim 6 including a bolt secured in said one side wall above said bearing bushing means and extending through a slot formed in said toothed disc, said first cam means being pivotally mounted on said last-mentioned bolt for actuating the gripper members of the storage drum for single-side sheet printing.

8. Assembly according to claim 7 wherein said first cam means comprise a gripper opening cam for single-side sheet printing, and including a tension spring fastened to an end of said gripper opening cam, on the one hand, and to said bearing bushing means, on the other hand, for biasing said gripper opening cam toward said bearing bushing means, and a cam member fixed to said toothed disc and operatively engageable with said gripper opening cam.

9. Assembly according to claim 1 wherein said control shaft is formed with a groove corresponding to a non-controlling position of said control shaft and a recess corresponding to said single control position of said control shaft for locking and securing said control shaft in said non-controlling and control position, respectively, and including a guard wall located in front of said drive gear means and secured to the exterior of a side wall of the printing press, said guard wall being formed with a bore and with an opening and having a latch pivotally mounted thereon, said control shaft extending through said bore, and said latch being selectively in engagement in said groove and in said recess depending upon the axial position of said control shaft.

10. Assembly according to claim 9 wherein said groove is formed with three sections of reduced diameter, the reduced diameter of one of said sections being equal to the reduced diameter section in said recess.

11. Assembly according to claim 9 wherein said latch is formed with two arms extending at an angle to one another and formed with a lug, one of said latch arms having an inner edge which, together with said lug, are operatively engageable with said reduced-diameter sections.

12. Assembly according to claim 9 including a stop bolt secured to the exterior of said guard wall above the pivot range of said pivotable latch.

13. Assembly according to claim 9 including a limit switch secured to the exterior of said side wall, and including a control hub located on said control shaft, said limit switch being operatively associated with said control hub in said single operative position of said control shaft.

14. Assembly according to claim 6 including a tensioning screw located on said one side wall above said control shaft for locking said toothed disc, a tensioning nut mounted on said tensioning screw outside said one side wall, a plate fastened to said tensioning nut and operatively associated with a control hub fixed on said first-mentioned control shaft for securing axial dislacement of said first-mentioned control shaft.

15. Assembly according to claim 3 including tensioning straps fastened by tensioning screws to the outer segments of said forward sheet-supporting segments, including a disc threadedly secured to the outer segment of said rearward sheet-supporting segments that is located adjacent said one side wall, and a ring gear threadedly secured to the outer segment of said rearward sheet-supporting segments that is located adjacent the other of said side walls, said disc and said ring gear being clampable by said tensioning straps and said tensioning screws.

16. Assembly according to claim 15 wherein said suction air control means comprises a valve fixed to the interior of said other of said side walls, and including a control disc fastened to the outer segment of said rearward sheet-supporting segments located adjacent the other of said side walls, said control disc being connected by a connecting tube to said sheet gripping means on said rotatable rearward sheet-supporting segments, said sheet gripping means being a suction bar.

17. Assembly according to claim 16 wherein said drive gear means drives said turning drum and is formed with a lug, and including tensioning screws and tensioning claws clamping a rotatable ring gear on said lug, said ring gear being in meshing engagement with drive gear means for driving said storage drum, and including a scale located on said ring gear, and an indication needle cooperating with said scale and carried by said drive gear means for driving said turning drum.

* * * * *